US005334472A

United States Patent [19]

Aoki et al.

[11] Patent Number: 5,334,472

[45] Date of Patent: Aug. 2, 1994

[54] TONER FOR DEVELOPING STATIC CHARGE IMAGES

[75] Inventors: Nobuyuki Aoki; Hideo Fujita; Jiro Aoshima, all of Shizuoka, Japan

[73] Assignee: Tomoegawa Paper Co., Ltd., Tokyo, Japan

[21] Appl. No.: 868,231

[22] Filed: Apr. 14, 1992

[30] Foreign Application Priority Data

Apr. 15, 1991 [JP] Japan ..... 3-108175
May 14, 1991 [JP] Japan ..... 3-136999

[51] Int. Cl.[5] ..... G03G 9/097
[52] U.S. Cl. ..... 430/109; 430/110
[58] Field of Search ..... 430/109, 110, 106.6, 430/106

[56] References Cited

U.S. PATENT DOCUMENTS 5,102,761 4/1992 Ohsaki et al. ..... 430/106
5,153,377 10/1992 Kuwashima et al. ..... 430/106.6

*Primary Examiner*—John Goodrow
*Attorney, Agent, or Firm*—Finnegan, Henderson, Farabow, Garrett & Dunner

[57] ABSTRACT

Present invention provides a toner for developing static charge images to the surface of which is adhered powder of aluminum oxide in the amount of 0.01% to 5% by weight. This aluminum oxide has a specific surface area of not less than 80 $m^2/g$ as measured by BET method, and absorptional $CO_2$ gas pieces of not more than 4.0 pieces/$nm^2$.

9 Claims, No Drawings

TONER FOR DEVELOPING STATIC CHARGE IMAGES

BACKGROUND OF THE INVENTION

1. Field of the Invention

The present invention relates to a toner for developing static charge images in an electrophotographic method, an electrostatic-printing recording method, and the like.

2. Description of Related Arts

In general, a toner having a negative charge property for developing static charge images, used in an electrophotographic method, is necessary for good fluidity. Therefore, on its surface, one or more agents for the fluidization is adhered. Further, the toner is used together with an iron powder or a ferrite carrier for developing static charge images so as to have optimal charge which is necessary to develop the images.

It has been known that powders of silica, titanium oxide, etc. are used as agents for the fluidization of the toner. When silica is used, the toner has a good fluidity. However, in this case, a decline of the image concentrations often occurs extended usage due to increased charge quantity. Further, the dependency of the humidity becomes stronger. Accordingly, in the condition of low humidity, a decline of the image concentrations particularly occurs due to marked increase of the charge quantity.

Alternatively, when titanium oxide is used, it can be suppressed to increase the charge quantity in the condition of low humidity, but the decrease in charge quantity, in the condition of high humidity, causes various problems, for example an increase in fog density and splashing of the toner.

In a color toner having a positive charged property for developing static charge images, a colloidal silica is generally used as the agent for the fluidization.

However, colloidal silica has essentially a strong negative charge property. Accordingly, during mixing with the carrier in the developing machine, the original charge quantity of the toner decreases, so that a toner using colloidal silica encounters various problems such as increase in fog density, splashing of the toner, and shortening of the developer's life due to lie the fluidizing agent in the developer.

In particular, the charging property of the color toner which includes a quaternary ammonium salt or a polyamine resin, is easily affected by the negative charge property of colloidal silica, and thus fogging and splashing of the toner during the development occurs frequently.

Further, when the color toner, on the surface of which the colloidal silica is adhered, is developed in the condition of high temperature and high humidity, the charge quantity of the toner decreases due to the moisture adsorption of the colloidal silica, causing various problems such as an increase of fog density. Additionally, in the condition of low temperature and low humidity, other various problems occur such as the decrease of the image concentrations due to increase of the charge quantity.

SUMMARY OF THE INVENTION

In order to solve the problems described above, it is a first object of the present invention to provide a toner having a negative charge property for developing static charge images, which can prevent decreases in image concentrations caused by extended usage, which can also prevent increases in fog density as well as decrease an image concentrations in any conditions.

Further, in order to solve the problems described above, it is a second object of the present invention to provide a color toner having a positive charge property for developing static charge images, which do not cause problems such as decreasing the image concentrations, increasing-of the fog density, splashing of the toner, and poor gradation property.

Therefore, the first aspect of the invention, which correspond to above first object, is directed to provide a toner having a negative charge property for developing static charge images, wherein to the toner is adhered an aluminum oxide powder in the amount of 0.05% to 5% by weight on the surface by various methods. The above mentioned aluminum oxide having a specific surface area of 75 $m^2/g$ to 250 $m^2/g$ measured by BET method, and absorptional $CO_2$ gas pieces of not more than 4.0 pieces/$nm^2$.

The general hydrophobic silica is placed through a surface treatment in order to lower the surface chemical activity. However, the hydrophobic silica can have itself a large amount Of the charge, thus it has disadvantages such as increasing the charge quantity of the developer. Compared to the hydrophobic silica, aluminum oxide has itself only a small charge amount, thus there is the advantage that very little variation of the toner's charge quantity occur. Furthermore, when the surface chemical activity is inactive, the moisture resistant property is improved, and the developer is not affected any condition. That is, in case that aluminum oxide has small absorptional $CO_2$ gas quantity, the surface becomes inactive, and it improved image properties are obtained in almost any condition.

In the first aspect of the invention, the aluminum oxide powder can be treated by an agent of the coupling treatment.

The second aspect of the invention, which correspond to above second objective, is directed to provide a color toner having a positive charge property for developing static charge images, wherein the color toner includes a binding agent, a coloring agent, and quaternary ammonium salt. To this color toner is adhered aluminum oxide powder in the amount of 0.01% to 1.0% by weight on the surface: the aluminum oxide having a specific surface area of not less than 80 $m^2/g$ measured by BET method, and absorptional $CO_2$ gas pieces of not more than 4.0 pieces/$nm^2$.

DETAILED DESCRIPTION OF THE INVENTION

In the first aspect of the invention, when a specific surface area of aluminum oxide, measured by BET method, is less than 75 $m^2/g$, sufficient fluidity cannot be obtained, thus it can not be used as an agent for the fluidization. Alternatively, if over 250 $m^2/g$, the adhesion to the toner is in sufficient, thus, causing increases in fog density as well as decreases in image concentration, due to the presence of aluminum oxide in the developer after extended usage.

Further, in the case when aluminum oxide has an absorptional $CO_2$ gas quantity of greater than 4.0 pieces/$nm^2$, the surface activity of aluminum oxide increases, and moisture resistant property rapidly decrease.

In the first aspect of the invention, the specific surface area of aluminum oxide and absorptional $CO_2$ gas pieces are measured by high resolution automatic gas absorptional apparatus currently being sale (for example, "BELSORP28" produced by BEL JAPAN Co., Ltd). In this case, the specific surface area of aluminum oxide is measured by BET method, and inactive $N_2$ gas is used as the absorptional gas. Concretely, the absorptional quantity Vm(cc/g) which is needed to form monomolecular layer on the surface of the aluminum oxide fine powder, and the specific surface area $S(m^2/g)$ is calculated by following formula.

$$S=4.35\times Vm(m^2/g)$$

Absorptional $CO_2$ gas pieces is calculated by following formula, after measuring absorptional $CO_2$ gas quantity.

$$\text{(absorptional } CO_2 \text{ gas pieces)} = \frac{\text{(absorptional } CO_2 \text{ gas quantity)} \times 6.02 \times 10^{23}}{22414 \times \text{(a specific surface area)} \times 10^{18}} \text{ (pieces/nm}^2\text{)}$$

In the first aspect of the invention, the fine powder of aluminum oxide can be treated by the agent of the coupling treatment so as to improve a dependence of the toner on the environmental conditions. A suitable agent of the coupling treatment may include one or more than one sorts of a material selected from the group consisting of dimethylsilicone, methyltrimethoxysilane, (3-aminopropyl)trimethoxysilane, (3-aminopropyl)triethoxysilane, (3-(2-aminoethoxyamino)propyl)triethoxysilane, (3-(2-aminoethoxyamino)propyl)trimethoxysilane, $C_8F_{17}SO_2NC_2H_5(CH_2)_3Si(CH_3O)_3$, or the like.

The toner particles according to the first aspect of the invention are obtained by the following steps: 1) mixing a binder resin, an agent for charge control, a coloring agent, and other additives as necessary; 2) melting and kneading this mixture; 3) cooling and solidifying the kneaded mixture; 4) pulverizing; and 5) classifying the pulverized mixture.

As the binder resin generally used for the toner, the following resins can be used: styrene resin, acrylic ester resin, styrene-acrylic copolymer resin, vinyl chloride resin, vinyl acetate resin, vinylidene chloride resin, phenolic resin, epoxy resin, polyester resin, and the like.

as the coloring agent generally used for the toner, the following can be used: carbon black, monoazo red pigment, disazo yellow pigment, quinacridone magenta pigment, anthraquinone dye, and the like.

As an agent for charge control according to the first aspect of the invention, for example, a metallic complex salt of monoazo pigment which gives a negative charge, an organic complex having electron accepting properties, a polyester having excess acid radical, or the like can be employed.

As necessary additives, the following can be listed: resin powder of polystyrene or polyacrylic ester; powder of silica, conductive titanium, zinc or the like; lubricant consisting of a metallic complex salt with a high fatty acid content or the like can be employed.

In the first aspect of the present invention, in order to fix the aluminum oxide fine powder to the toner particle surface, a conventional mixer such as paddle mixer, turbine type mixer, a high-speed mixer ("Henscheil Mixer"), or the like can be employed.

Furthermore, a surface reformer such as "Ang mil", produced by Hosokawa Micron Corporation, "Nara Hybridization system", produced by Nara Machinery Co., Ltd., or the like can be employed.

The amount of the aluminum oxide fine powder which is adhered onto the toner particles, employed in the first aspect of the present invention, is between 0.05 and 5.0% by weight, based on the total weight of the toner. In the first aspect of the present invention, if the amount of the aluminum oxide fine powder is not more than 0.05% by weight in the toner, the fluidity will be inadequate. On the other hand, if the amount of aluminium oxide is 5.0% or greater by weight in the toner, then frictional electricity between the toner particles and the carrier will be affected, thereby causing various problems.

When a toner having a negative charge property for developing static charge images, according to the first aspect of the invention, is used in developing, it is generally used with iron powder carrier, ferrite carrier, or the like, as the binary system developer. In this case, silicone coating ferrite carrier is preferable so as to maintain the life of the developer for a long time. Furthermore, 0.2 to 2.0 $\mu$A of electrical current value is preferable so as to provide high image quality.

In the second aspect of the present invention, the hyperfine powder of aluminum oxide, which is produced by hydrolyzing aluminum chloride anhydride at high temperatures(flame), is employed as the aluminum oxide particles. The surface of this aluminum oxide is treated by the agent of the coupling treatment, and has a specific surface area of not less than 80 $m^2/g$ measured by BET method, and absorptional $CO_2$ gas pieces of not more than 4.0 pieces/$nm^2$. The specific surface area measured by BET method and absorptional $CO_2$ gas pieces can be controlled by appropriately selecting the type of aluminum oxide particles to become the core, the type of agent of the coupling treatment, and varying the amount of the coupling treatment. "Aluminum Oxide C" produced by Nippon Aerosil Co., Ltd- or the like is employed as the fine powder of aluminum oxide in the second aspect of the present invention. A suitable agent of the coupling treatment can include any of the compounds mentioned in the first aspect of the present invention.

In the second aspect of the present invention, in the case when the aluminum oxide has absorptional $CO_2$ gas pieces of more than 4.0 pieces/$nm^2$, an image concentration decreases due to the increases in the frictional electrification amount during mixing in the developing machine under conditions of ordinary temperature and humidity (25° C./60% RH), or under conditions of low temperature and low humidity (10° C./20% RH). Further, under the conditions of high temperature and high humidity (35° C./85% RH), the amount of the frictional electrification decreases due to absorption of moisture, causing problems such as increasing the fog density and splashing of the toner.

In the second aspect of the invention, in case when a specific surface area of aluminum oxide, measured by BET method, is less than 80 $m^2/g$, fluidity is insufficient, thus a color toner having a positive charged property easily forms an aggregation.

In the second aspect of the invention, in case when the amount of the aluminum oxide fine powder is not more than 0.01% by weight in the toner,-then the fluidity will not be adequate. On the other hand, if the amount of aluminum oxide is not less than 1.0% by weight in the toner, then the amount of frictional electrification property of the color toner having a positive charged property, decreases due to the aluminum oxide easily becoming negatively charged, originally. This causes problems such as increase of fog density and splashing of the toner.

The toner particles according to the second aspect of the present invention is obtained by the following steps: 1) mixing a binder resin, a coloring agent, quaternary ammonium salt, and other additives as necessary; 2) melting and kneading this mixture; 3) cooling and solidifying the kneaded mixture; 4) pulverizing; and 5) classifying the pulverized mixture.

As the binder resin, any of the resins mentioned in the first aspect of the present invention can be used.

As the coloring agent in the second aspect of the invention, monoazo red pigment, disazo yellow pigment, quinacridone magenta pigment, copper phthalocyanine blue pigment, and the like can be employed. These coloring agent should be present in an amount of 2 parts by weight to 15 parts by weight per 100 parts by weight of the binder resin.

Further, the toner particles according to the second aspect of the invention, include quaternary ammonium salt. A quaternary ammonium salt currently being sale "Bontron P-51" or "Bontron AFPB" produced by Orient Chemical Industrial Co., Ltd., "TP-302" or "TP-415" produced by Hodogaya Chemical Co., Ltd., or the like can be employed.

An offset resisting agent such as low molecular weight polypropylene or low molecular weight polyethylene can be added if necessary.

In the second accept of the present invention, in order to affix the fine powder of aluminum oxide to the toner particle surface, a conventional mixer listed in the first aspect, can be employed.

When a color toner having a positive charging property for developing static charge images, according to the first aspect of the invention, is used for developing, it is generally used with iron powder carrier, ferrite carrier, or the like, as a binary system developer. In this case, silicone coating ferrite carrier is preferable so as to maintain the life of the developer for a long time. Furthermore, 0.2 to 2.0 $\mu$A of electrical current value is preferable so as to provide a high image quality. Further, it can be used as non-magnetic unary system developer, not to use with the carrier.

EXAMPLES

The present invention will be explained in detail hereinbelow with reference to the examples.

The following is a evaluation of a toner compound which is used in the Examples of the first aspect of the present invention.

| | |
|---|---|
| Styrene acrylic copolymer binder ($Mn = 4.2 \times 10^3$, $Mw = 13.5 \times 10^4$, $Mw/Mn = 32$) | 100 parts |
| Carbon black (#40: supplied by Mitsubishi kasei Corporation) | 5 parts |
| Monoazo metal complex dye (Bontoron S-44: supplied by Orient Chemical Industrial Co., Ltd.) | 2 parts |
| Polypropylene (Viscoal 660P: supplied by Sanyo Chemical Industries, Ltd.) | 5 parts |

In this case, particle size distribution is as follows:

| | |
|---|---|
| Vol. (50%) diameter | 10.6 $\mu$m |

-continued

| | |
|---|---|
| Average particle diameter | 11.1 $\mu$m |
| Particle diameter vol. % not less than 20 $\mu$m | 0% |
| Pop (not exceeding 5 $\mu$m) | 6.5% |
| Pop (50%) | 9.2 $\mu$m |

The conditions of evaluating experiment of toner properties are as follows.

(1) Temperature and humidity

| | |
|---|---|
| Ordinary temperature and ordinary humidity (showed as N/N in tables) | (25° C./60%) |
| Low temperature and low humidity (showed as L/L in tables) | (10° C./20%) |
| High temperature and high humidity (showed as L/L in tables) | (35° C./85%) |

(2) A copy test is carried out using a copy machine "Leodry 3810" produced by Toshiba Corporation.

The value of the toner's properties showed in Examples are image concentration (showed as I.D. in tables), fog density (showed as B.G. in tables) and charge quantity.

The charging quantity is measured by a blowoff charging quantity measuring apparatus produced by Toshiba Chemical Corporation. The image concentration is measured by Macbeth reflecting densitometer, and the fog density is measured by a color-difference meter produced by Nippon Denshoku Corporation.

EXAMPLE 1

1 kg of the above mentioned toner particles was mixed with 2g (0.2 weight %) of aluminum oxide fine powder which was treated with $C_8F_{17}SO_2NC_2H_5(CH_2)_3Si(CH_3O)_3$ and dimethylsilicone, and had a specific surface area of 90 $m^2/g$ measured by BET method and absorptional $CO_2$ gas pieces of 3.27 pieces/$nm^2$. After that, aluminum oxide fine powder was adhered to the toner surface by a "Henscheil Mixer" having a volume of 10 liters, under the condition of 3000 rpm for 2 minutes. This toner was combined with silicone coating ferrite carrier having a carrier electrical current value of 0.5 $\mu$A, so as to produce the developer. The copy test was carried out using this developer under each of the above mentioned conditions.

EXAMPLE 2

1 kg of above toner particles was mixed with 2 g (0.2 weight %) of aluminum oxide fine powder which was treated with methyltrimethoxysilane, having a specific surface area of 122 $m^2/g$ as measured by BET method and absorptional $CO_2$ gas pieces of 2.65 pieces/$nm^2$. After that, aluminum oxide fine powder was adhered to the toner surface by a "Henscheil Mixer" having a volume of 10 liters, under the condition of 3000 rpm for 2 minutes. This toner was combined with silicone coating ferrite carrier having a carrier electrical current value of 0.5 $\mu$A, so as to produce the developer. The copy test was carried out using this developer under each of the above mentioned conditions.

EXAMPLE 3

1 kg of above toner particles was mixed with 2 g (0.2 weight %) of aluminum oxide fine powder which was treated with (3-aminopropyl)trimethoxysilane, having a specific surface area of 128 $m^2/g$ as measured by BET method and absorptional $CO_2$ gas pieces of 3.88 pieces/nm$^2$. After that, aluminum oxide fine powder was adhered to the toner surface by a "Henscheil Mixer" having a volume of 10 liters, under the condition of 3000 rpm for 2 minutes. This toner was combined with silicone coating ferrite carrier having a carrier electrical current value of 0.5 $\mu$A, so as to produce the developer. The copy test was carried out using this developer under each of the above mentioned conditions.

EXAMPLE 4

1 kg of above toner particles was mixed with 2 g (0.2 weight %) of aluminum oxide fine powder having a specific surface area of 203 m$^2$/g as measured by BET method and absorptional $CO_2$ gas pieces of 2.51 pieces/nm$^2$. After that, aluminum oxide fine powder was adhered to the toner surface by a "Henscheil Mixer" having a volume of 10 liters, under the condition of 3000 rpm for 2 minutes. This toner was combined with silicone coating ferrite carrier having a carrier electrical current value of 0.5 $\mu$A, so as to produce the developer. The copy test was carried out using this developer under each of the above mentioned conditions.

EXAMPLE 5

1 kg of above toner particles was mixed with 2 g (0.2 weight %) of aluminum oxide fine powder having a specific surface area of 194 m$^2$/g as measured by BET method and absorptional $CO_2$ gas pieces of 3.76 pieces/nm$^2$. After that, aluminum oxide fine powder was adhered to the toner surface by a "Henscheil Mixer" having a volume of 10 liters, under the condition of 3000 rpm for 2 minutes. This toner was combined with silicone coating ferrite carrier having a carrier electrical current value of 0.5 $\mu$A, so as to produce the developer. The copy test was carried out using this developer under each of the above mentioned conditions.

The results of Example 1, Example 2, Example 3, Example 4 and Example 5 are shown in Tables 1, 2 and 3.

COMPARATIVE EXAMPLE 1

1 kg of above toner particles was mixed with (0.2 weight %) of aluminum oxide fine powder having a specific surface area of 118 m$^2$/g as measured by BET method and absorptional $CO_2$ gas pieces of 5.10 pieces/nm$^2$. After that, aluminum oxide fine powder was adhered to the toner surface by a "Henscheil Mixer" having a volume of 10 liters, under the condition of 3000 rpm for 2 minutes. This toner was combined with silicone coating ferrite carrier having a carrier electrical current value of 0.5 $\mu$A, so as to produce the developer. The copy test was carried out using this developer under each of the above mentioned conditions.

COMPARATIVE EXAMPLE 2

1 kg of above toner particles was mixed with 2 g (0.2 weight %) of aluminum oxide fine powder having a specific surface area of 195 m$^2$/g as measured by BET method and absorptional $CO_2$ gas pieces of 5.42 pieces/nm$^2$. After that, aluminum oxide fine powder was adhered to the toner surface by a "Henscheil Mixer" having a volume of 10 liters, under the condition of 3000 rpm for 2 minutes. This toner was combined with silicone coating ferrite carrier having a carrier electrical current value of 0.5 $\mu$A, so as to produce the developer. The copy test was carried out using this developer under each of the above mentioned conditions.

COMPARATIVE EXAMPLE 3

1 kg of above toner particles was mixed with 2 g (0.2 weight %) of aluminum oxide fine powder having a specific surface area of 48 m$^2$/g as measured by BET method and absorptional $CO_2$ gas pieces of 3.20 pieces/nm$^2$. After that, aluminum oxide fine powder was adhered to the toner surface by a "Henscheil Mixer" having a volume of 10 liters, under the condition of 3000 rpm for 2 minutes. This toner was combined with silicone coating ferrite carrier having a carrier electrical current value of 0.5 $\mu$A, so as to produce the developer. The copy test was carried out using this developer under each of the above mentioned conditions.

COMPARATIVE EXAMPLE 4

1 kg of above toner particles was mixed with 2 g (0.2 weight %) of aluminum oxide fine powder having a specific surface area of 286 m$^2$/g as measured by BET method and absorptional $CO_2$ gas pieces of 3.11 pieces/nm$^2$. After that, aluminum oxide fine powder was adhered to the toner surface by a "Henscheil Mixer" having a volume of 10 liters, under the condition of 3000 rpm for 2 minutes. This toner was combined with silicone coating ferrite carrier having a carrier electrical current value of 0.5 $\mu$A, so as to produce the developer. The copy test was carried out using this developer under each of the above mentioned conditions.

The results of the life test of Comparative Examples 1, 2, 3 and 4 under the condition of N/N, L/L and H/H are shown in Tables 4, 5 and 6.

These results increases in the fog density and decreases in the image concentration after the copy test of thirty thousand sheets of paper. On the other hand, all of the Examples of the present invention showed excellent results.

In these Tables, "Ini" indicates the beginning, and "K" indicates the number of sheets of paper by the thousands.

TABLE 1

| Samples | Specific surface area (m$^2$/g) | Absorptional $CO_2$ gas pieces (pieces/nm$^2$) | Adhered weight (weight %) | Data | Ini | 10K | 20K | 30K |
|---|---|---|---|---|---|---|---|---|
| Example 1 | 90 | 3.27 | 0.2 | Charge quantity | 17.1 | 17.0 | 17.5 | 17.3 |
| | | | | I.D. | 1.38 | 1.37 | 1.37 | 1.38 |
| | | | | B.G. | 0.50 | 0.48 | 0.53 | 0.55 |
| Example 2 | 122 | 2.65 | 0.2 | Charge quantity | 16.8 | 16.5 | 16.6 | 16.4 |
| | | | | I.D. | 1.38 | 1.39 | 1.39 | 1.39 |
| | | | | B.G. | 0.50 | 0.55 | 0.52 | 0.51 |
| Example 3 | 128 | 3.88 | 0.2 | Charge quantity | 17.3 | 17.5 | 17.0 | 17.8 |
| | | | | I.D. | 1.36 | 1.37 | 1.37 | 1.36 |
| | | | | B.G. | 0.52 | 0.50 | 0.49 | 0.57 |
| Example 4 | 203 | 2.51 | 0.2 | Charge quantity | 17.8 | 17.9 | 17.6 | 18.0 |
| | | | | I.D. | 1.36 | 1.37 | 1.37 | 1.37 |
| | | | | B.G. | 0.56 | 0.57 | 0.58 | 0.59 |

TABLE 1-continued

| Samples | Specific surface area ($m^2/g$) | Absorptional $CO_2$ gas pieces ($pieces/nm^2$) | Adhered weight (weight %) | Data | Ini | 10K | 20K | 30K |
|---|---|---|---|---|---|---|---|---|
| Example 5 | 194 | 3.76 | 0.2 | Charge quantity | 18.1 | 17.9 | 17.8 | 18.0 |
| | | | | I.D. | 1.36 | 1.36 | 1.37 | 1.36 |
| | | | | B.G. | 0.57 | 0.58 | 0.60 | 0.55 |

Condition N/N

TABLE 2

| Samples | Specific surface area ($m^2/g$) | Absorptional $CO_2$ gas pieces ($pieces/nm^2$) | Adhered weight (weight %) | Data | Ini | 10K | 20K | 30K |
|---|---|---|---|---|---|---|---|---|
| Example 1 | 90 | 3.27 | 0.2 | Charge quantity | 17.7 | 17.6 | 17.8 | 17.5 |
| | | | | I.D. | 1.35 | 1.35 | 1.35 | 1.34 |
| | | | | B.G. | 0.61 | 0.63 | 0.62 | 0.60 |
| Example 2 | 122 | 2.65 | 0.2 | Charge quantity | 17.2 | 17.3 | 17.5 | 17.6 |
| | | | | I.D. | 1.36 | 1.35 | 1.35 | 1.35 |
| | | | | B.G. | 0.62 | 0.64 | 0.63 | 0.60 |
| Example 3 | 128 | 3.88 | 0.2 | Charge quantity | 17.8 | 17.6 | 17.9 | 17.8 |
| | | | | I.D. | 1.35 | 1.34 | 1.34 | 1.35 |
| | | | | B.G. | 0.58 | 0.59 | 0.57 | 0.56 |
| Example 4 | 203 | 2.51 | 0.2 | Charge quantity | 17.5 | 17.4 | 17.3 | 17.4 |
| | | | | I.D. | 1.35 | 1.34 | 1.36 | 1.35 |
| | | | | B.G. | 0.58 | 0.59 | 0.55 | 0.54 |
| Example 5 | 194 | 3.76 | 0.2 | Charge quantity | 18.3 | 18.1 | 18.0 | 18.2 |
| | | | | I.D. | 1.35 | 1.34 | 1.35 | 1.34 |
| | | | | B.G. | 0.58 | 0.58 | 0.60 | 0.61 |

Condition L/L

TABLE 3

| Samples | Specific surface area ($m^2/g$) | Absorptional $CO_2$ gas pieces ($pieces/nm^2$) | Adhered weight (weight %) | Data | Ini | 10K | 20K | 30K |
|---|---|---|---|---|---|---|---|---|
| Example 1 | 90 | 3.27 | 0.2 | Charge quantity | 16.6 | 16.5 | 16.8 | 16.9 |
| | | | | I.D. | 1.39 | 1.40 | 1.39 | 1.39 |
| | | | | B.G. | 0.41 | 0.42 | 0.43 | 0.40 |
| Example 2 | 122 | 2.65 | 0.2 | Charge quantity | 16.2 | 16.5 | 16.3 | 16.6 |
| | | | | I.D. | 1.40 | 1.41 | 1.40 | 1.39 |
| | | | | B.G. | 0.44 | 0.42 | 0.39 | 0.45 |
| Example 3 | 128 | 3.88 | 0.2 | Charge quantity | 16.8 | 16.7 | 16.6 | 16.9 |
| | | | | I.D. | 1.39 | 1.39 | 1.39 | 1.39 |
| | | | | B.G. | 0.49 | 0.47 | 0.50 | 0.49 |
| Example 4 | 203 | 2.51 | 0.2 | Charge quantity | 17.1 | 16.9 | 17.2 | 17.0 |
| | | | | I.D. | 1.38 | 1.39 | 1.38 | 1.39 |
| | | | | B.G. | 0.50 | 0.52 | 0.49 | 0.49 |
| Example 5 | 194 | 3.76 | 0.2 | Charge quantity | 17.1 | 17.0 | 17.3 | 17.5 |
| | | | | I.D. | 0.48 | 0.47 | 0.46 | 0.48 |
| | | | | B.G. | 1.37 | 1.38 | 1.39 | 1.37 |

Condition H/H

TABLE 4

| Samples | Specific surface ($m^2/g$) | Absorptional $CO_2$ gas pieces ($pieces/nm^2$) | Adhered weight (weight %) | Data | Ini | 10K | 20K | 30K |
|---|---|---|---|---|---|---|---|---|
| Comparative example 1 | 118 | 5.10 | 0.2 | Charge quantity | 17.2 | 17.9 | 18.8 | 19.8 |
| | | | | I.D. | 1.38 | 1.37 | 1.34 | 1.30 |
| | | | | B.G. | 0.62 | 0.78 | 0.99 | 1.02 |
| Comparative example 2 | 195 | 5.42 | 0.2 | Charge quantity | 18.5 | 18.7 | 19.8 | 20.1 |
| | | | | I.D. | 1.35 | 1.35 | 1.31 | 1.29 |
| | | | | B.G. | 0.63 | 0.72 | 0.98 | 1.05 |
| Comparative example 3 | 48 | 3.20 | 0.2 | Charge quantity | 17.6 | 19.9 | 20.1 | 22.5 |
| | | | | I.D. | 1.36 | 1.29 | 1.23 | 1.15 |
| | | | | B.G. | 0.62 | 0.67 | 0.45 | 0.55 |
| Comparative example 4 | 286 | 3.11 | 0.2 | Charge quantity | 17.2 | 16.4 | 16.4 | 15.3 |
| | | | | I.D. | 1.36 | 1.38 | 1.39 | 1.42 |
| | | | | B.G. | 0.70 | 0.75 | 1.11 | 1.25 |

Condition N/N

TABLE 5

| Samples | Specific surface ($m^2/g$) | Absorptional $CO_2$ gas pieces (pieces/$nm^2$) | Adhered weight (weight %) | Data | Ini | 10K | 20K | 30K |
|---|---|---|---|---|---|---|---|---|
| Comparative example 1 | 118 | 5.10 | 0.2 | Charge quantity | 19.2 | 20.3 | 21.5 | 22.6 |
| | | | | I.D. | 1.30 | 1.27 | 1.17 | 1.10 |
| | | | | B.G. | 0.62 | 0.78 | 0.99 | 1.02 |
| Comparative example 2 | 195 | 5.42 | 0.2 | Charge quantity | 20.2 | 21.3 | 23.2 | 23.5 |
| | | | | I.D. | 1.29 | 1.27 | 1.10 | 1.09 |
| | | | | B.G. | 0.72 | 0.88 | 1.02 | 1.01 |
| Comparative example 3 | 48 | 3.20 | 0.2 | Charge quantity | 17.2 | 18.0 | 22.5 | 23.5 |
| | | | | I.D. | 1.35 | 1.30 | 1.20 | 1.15 |
| | | | | B.G. | 0.76 | 1.00 | 1.09 | 1.11 |
| Comparative example 4 | 286 | 3.11 | 0.2 | Charge quantity | 22.8 | 25.1 | — | — |
| | | | | I.D. | 1.10 | 1.09 | — | — |
| | | | | B.G. | 0.99 | 1.20 | — | — |

Condition L/L

TABLE 6

| Samples | Specific surface ($m^2/g$) | Absorptional $CO_2$ gas pieces (pieces/$nm^2$) | Adhered weight (weight %) | Data | Ini | 10K | 20K | 30K |
|---|---|---|---|---|---|---|---|---|
| Comparative example 1 | 118 | 5.10 | 0.2 | Charge quantity | 15.8 | 15.7 | 14.9 | 14.5 |
| | | | | I.D. | 1.42 | 1.44 | 1.45 | 1.46 |
| | | | | B.G. | 0.99 | 1.01 | 1.15 | 1.20 |
| Comparative example 2 | 195 | 5.42 | 0.2 | Charge quantity | 15.3 | 15.0 | 14.4 | 14.0 |
| | | | | I.D. | 1.42 | 1.45 | 1.46 | 1.48 |
| | | | | B.G. | 1.01 | 1.04 | 1.20 | 1.22 |
| Comparative example 3 | 48 | 3.20 | 0.2 | Charge quantity | 15.0 | 14.8 | 14.0 | — |
| | | | | I.D. | 1.43 | 1.43 | 1.40 | — |
| | | | | B.G. | 0.88 | 1.21 | 1.25 | — |
| Comparative example 4 | 286 | 3.11 | 0.2 | Charge quantity | 16.0 | 15.3 | 14.9 | 14.9 |
| | | | | I.D. | 1.38 | 1.40 | 1.45 | 1.47 |
| | | | | B.G. | 0.77 | 0.98 | 1.05 | 1.11 |

Condition H/H

The following is a toner compound which is used in the Examples of the second aspect of the present invention.

First, three sorts of the toner particles were prepared as follows:

| [Toner particle 1] | |
|---|---|
| Styrene-acrylic ester copolymer resin ($Mn = 4.2 \times 10^3$, $Mw = 13.5 \times 10^4$, $Mw/Mn = 32$) | 100 parts |
| C.I. Pigment Red 112 ("Permanent Red FNG" supplied by Sanyo Shikiso Corporation) | 5 parts |
| Quaternary ammonium salt ("BontronP-51" supplied by Orient Chemical Industries, Ltd.) | 2 parts |
| Polypropylene ("Bisco1660P" supplied by Sanyo Chemical Industries, Ltd.) | 5 parts |

The above composition was mixed in a supermixer, melted and kneaded in a extruder, crushed by a jet mill after cooling and solidified, and finally classified to produce toner particle 1 having an average particle diameter of 14 $\mu$m.

| [Toner particle 2] | |
|---|---|
| Styrene-acrylic ester copolymer resin ($Mn = 4.2 \times 10^3$, $Mw = 13.5 \times 10^4$, $Mw/Mn = 32$) | 100 parts |
| C.I. Pigment Yellow 81 ("Yellow F10G" supplied by Sanyo Shikiso Corporation) | 5 parts |
| Quaternary ammonium salt ("BontronP-51" supplied by Orient Chemical Industries, Ltd.) | 2 parts |
| Polypropylene ("Bisco1660P" supplied by Sanyo Chemical Industries, Ltd.) | 5 parts |

-continued

| [Toner particle 2] |
|---|
| Ltd.) |

Toner particle 2 was produced by the same process described for Toner particle 1, from the above composition.

| [Toner particle 3] | |
|---|---|
| Styrene-acrylic ester copolymer resin ($Mn = 4.2 \times 10^3$, $Mw = 13.5 \times 10^4$, $Mw/Mn = 32$) | 100 parts |
| C.I. Pigment Blue 15:3 ("Sumiton Cyaninblue LBGN" supplied by Sumitomo Chemical Industries, Ltd.) | 5 parts |
| Quaternary ammonium salt ("BontronP-51" supplied by Orient Chemical Industries, Ltd.) | 2 parts |
| Polypropylene ("Bisco1660P" supplied by Sanyo Chemical Industries, Ltd.) | 5 parts |

Toner particle 3 was produced by the same process described for Toner particle 1, from the above composition.

Next, a color toner was produced using toner particles 1 to 3 as follows:

EXAMPLE 6

0.1 weight % of aluminum oxide, treated with 2.5 weight % of $C_8F_{17}SO_2NC_2H_5(CH_2)_3Si(CH_3O)_3$ and 1.25 weight % of dimethylsilicone, having 87 $m^2/g$ of a specific surface area as measured by BET method and 3.3 pieces/$nm^2$ of absorptional $CO_2$ gas pieces, was added to above toner particle 1. After that, aluminum oxide was adhered to the toner surface by "Henscheil Mixer" having 10 liter volume, under the conditions of 3000 rpm during 1 minutes, so as to produce the color toner: the color toner was red in color and possessed a positive charged property according to the second aspect of the present invention.

EXAMPLE 7

0.1 weight % of aluminum oxide, treated with 2.5 weight of $C_8F_{17}SO_2NC_2H_5(CH_2)_3Si(CH_3O)_3$ and 1.25 weight % of dimethylsilicone, having 87 $m^2/g$ of a specific surface area as measured by BET method and 3.3 pieces/$nm^2$ of absorptional $CO_2$ gas pieces, was added to above toner particle 2. After that, aluminum oxide was adhered to the toner surface by "Henscheil Mixer" having 10 liter volume, under the conditions of 3000 rpm during 1 minutes, so as to produce the color toner: the color toner was red in color and possessed a positive charged property according to the second aspect of the present invention.

EXAMPLE 8

0.1 weight % of aluminum oxide, treated with 2.5 weight % of $C_8F_{17}SO_2NC_2H_5(CH_2)_3Si(CH_3O)_3$ and 1.25 weight % of dimethylsilicone, having 87 $m^2/g$ of a specific surface area measured by BET method and 3.3 pieces/$nm^2$ of absorptional $CO_2$ gas pieces, was added to the above toner particle 3. After that, aluminum oxide was adhered to the toner surface by "Henscheil Mixer" having 10 liter volume, under the conditions of 3000 rpm during 1 minutes, so as to produce the color toner: the color toner was red in color and possessed a positive charged property according to the second aspect of the invention.

COMPARATIVE EXAMPLE 5

0.2 weight % of "Colloidal Silica R-972" (supplied by Nippon Aerosil Co., Ltd.) was added to the above toner particle 1. After that, "Colloidal Silica R-972" was adhered to the toner surface by "Henscheil Mixer" having 10 liter volume, under the conditions of 3000 rpm during 1 minutes, so as to produce the color toner for comparison.

COMPARATIVE EXAMPLE 6

0.2 weight % of aluminum oxide powder having a specific surface area of 92 $m^2/g$ as measured by BET method and 5.1 pieces/$nm^2$ of absorptional $CO_2$ gas pieces, was added to the above toner particle 1. After that, aluminum oxide was adhered to the toner surface by "Henscheil Mixer" having 10 liter volume, under the conditions of 3000 rpm during 1 minutes, so as to produce the color toner for comparison.

COMPARATIVE EXAMPLE 7

0.2 weight % of aluminum oxide powder having a specific surface area of 10 $m^2/g$ as measured by BET method and 4.4 pieces/$nm^2$ of absorptional $CO_2$ gas pieces was added to the above toner particle 1. After that, aluminum oxide was adhered to the toner surface by "Henscheil Mixer" having 10 liter volume, under the conditions of 3000 rpm during 1 minutes, so as to produce the color toner for comparison.

COMPARATIVE EXAMPLE 8

0.2 weight % of "Colloidal Silica R-972" (supplied by Nippon Aerosil Co., Ltd.) was added to the above toner particle 2. After that, "Colloidal Silica R-972" was adhered to the toner surface by "Henscheil Mixer" having 10 liter volume, under the conditions of 3000 rpm during 1 minutes, so as to produce the color toner for comparison.

COMPARATIVE EXAMPLE 9

0.2 weight % of aluminum oxide powder having a specific surface area of 92 $m^2/g$ as measured by BET method and 5.1 pieces/$nm^2$ of absorptional $CO_2$ gas pieces was added to the above toner particle 2. After that, aluminum oxide was adhered to the toner surface by "Henscheil Mixer" having 10 liter volume, under the conditions of 3000 rpm during 1 minutes, so as to produce the color toner for comparison.

COMPARATIVE EXAMPLE 10

0.2 weight % of aluminum oxide powder having a specific surface area of 10 $m^2/g$ as measured by BET method and 4.4 pieces/$nm^2$ of absorptional $CO_2$ gas pieces was added to the above toner particle 2. After that, aluminum oxide was adhered to the toner surface by "Henscheil Mixer" having 10 liter volume, under the conditions of 3000 rpm during 1 minutes, so as to produce the color toner for comparison

COMPARATIVE EXAMPLE 11

0.2 weight % of "Colloidal Silica R-972" (supplied by Nippon Aerosil Co., Ltd.) was added to above toner particle 3. After that, "Colloidal Silica R-972" was adhered to the toner surface by "Henscheil Mixer" having 10 liter volume, under the conditions of 3000 rpm during 1 minutes, so as to produce the color toner for comparison.

COMPARATIVE EXAMPLE 12

0.2 weight % of aluminum oxide powder having a specific surface area of 92 $m^2/g$ as measured by BET method and 5.1 pieces/$nm^2$ of absorptional $CO_2$ gas pieces was added to above toner particle 3. After that, aluminum oxide was adhered to the toner surface by "Henscheil Mixer" having 10 liter volume, under the conditions of 3000 rpm during 1 minutes, so as to produce the color toner for comparison.

COMPARATIVE EXAMPLE 13

0.2 weight % of aluminum oxide powder having a specific surface area of 10 $m^2/g$ as measured by BET method and 4.4 pieces/$nm^2$ of absorptional $CO_2$ gas pieces was added to above toner particle 3. After that, aluminum oxide was adhered to the toner surface by "Henscheil Mixer" having 10 liter volume, under the conditions of 3000 rpm during 1 minutes, so as to produce the color toner for comparison.

6 parts of these color toner was mixed with 100 parts of silicone coating ferrite carrier, having a Tarrier electrical current value of 1.0 $\mu$A and a saturation magnetization of 40 emu/g, so as to produce a binary system developer. A copy test of 5000 sheets of paper was carried out using this binary system developer under each of the conditions mentioned in Examples of the first aspect. The result was showed in Table 7, 8 and 9.

A copy test is carried out by using "SFT-Z90", a copying machine produced by Sanyo Electric Corporation. The frictional charging quantity is measured by a blowoff charging quantity measuring apparatus produced by Toshiba Chemical Corporation. The image concentration is measured by Macbeth reflecting densitometer, and the fog density is measured by a color-difference meter produced by Nippon Denshoku Corporation.

The toner splashing is evaluated by visual observation of the condition surrounding the developing machine.

No toner splashing

A small amount of toner splashing

A large amount of toner splashing

A bulk specific gravity was measured by JIS K-5101 in order to evaluate the fluidity of these color toners; these results are shown in Table 10.

As will be apparent from the results shown in Tables 7, 8 and 9, the color toner of Examples 6 to 8, according to the second aspect of the present invention, encountered no problems relating to image concentration, fog density was low, and toner splashing did not occur. On the other hand, all results of Comparative Examples showed toner splashing after undergoing a copy test of 5000 sheets of paper, and was confirmed the increase of the fog density in the conditions of H/H and L/L.

Further, as will be apparent from the results shown in Table 10, it was confirmed that the color toner of Examples 6 to 8 had good fluidity and a comparatively big bulk specific gravity when the same coloring agent was used in the Examples and the comparative Examples.

TABLE 7

| | | Initial | | | 5000 sheets | | |
|---|---|---|---|---|---|---|---|
| | | N/N | L/L | H/H | N/N | L/L | H/H |
| Example 6 | Frictional charge quantity (μc/g) | 11.1 | 14.3 | 10.7 | 13.0 | 16.6 | 10.2 |
| | I.D. | 1.35 | 1.33 | 1.37 | 1.31 | 1.33 | 1.36 |
| | B.G. | 0.42 | 0.18 | 0.45 | 0.49 | 0.21 | 0.41 |
| | Toner splashing | ○ | ○ | ○ | ○ | ○ | ○ |
| Comparative example 5 | Frictional charge quantity (μc/g) | 10.2 | 12.4 | 7.4 | 8.4 | 13.7 | 4.3 |
| | I.D. | 1.34 | 1.32 | 1.36 | 1.36 | 1.33 | 1.36 |
| | B.G. | 0.34 | 0.24 | 0.65 | 0.87 | 0.60 | 1.16 |
| | Toner splashing | Δ | ○ | X | X | X | X |
| Comparative example 6 | Frictional charge quantity (μc/g) | 11.0 | 13.6 | 8.7 | 9.4 | 14.9 | 5.3 |
| | I.D | 1.35 | 1.32 | 1.35 | 1.36 | 1.31 | 1.37 |
| | B.G. | 0.28 | 0.31 | 0.62 | 0.74 | 0.75 | 1.01 |
| | Toner splashing | Δ | ○ | X | X | Δ | X |
| Comparative example 7 | Frictional charge quantity (μc/g) | 11.3 | 12.6 | 9.7 | 10.0 | 12.1 | 7.2 |
| | I.D. | 1.34 | 1.32 | 1.36 | 1.33 | 1.31 | 1.36 |
| | B.G. | 0.34 | 0.28 | 0.39 | 0.42 | 0.49 | 0.75 |
| | Toner splashing | ○ | ○ | Δ | Δ | Δ | X |

TABLE 8

| | | Initial | | | 5000 sheets | | |
|---|---|---|---|---|---|---|---|
| | | N/N | L/L | H/H | N/N | L/L | H/H |
| Example 7 | Frictional charge quantitiy (μc/g) | 10.3 | 12.4 | 9.4 | 11.2 | 12.8 | 9.0 |
| | I.D. | 1.41 | 1.37 | 1.42 | 1.38 | 1.35 | 1.40 |
| | B.G. | 0.35 | 0.29 | 0.26 | 0.41 | 0.46 | 0.33 |
| | Toner splashing | ○ | ○ | ○ | ○ | ○ | ○ |
| Comparative example 8 | Frictional charge quantity (μc/g) | 9.6 | 11.5 | 7.3 | Interruption due to an excessive amount of the toner splashing | | |
| | I.D. | 1.43 | 1.40 | 1.44 | | | |
| | B.G. | 0.51 | 0.64 | 1.11 | | | |
| | Toner splashing | X | Δ | X | | | |

TABLE 8-continued

| | | Initial | | | 5000 sheets | | |
|---|---|---|---|---|---|---|---|
| | | N/N | L/L | H/H | N/N | L/L | H/H |
| Comparative example 9 | Frictional charge quantity (μc/g) | 9.3 | 10.6 | 6.4 | Interruption due to an excessive amount of the toner splashing | | |
| | I.D. | 1.43 | 1.37 | 1.45 | | | |
| | B.G. | 0.43 | 0.37 | 0.85 | | | |
| | Toner splashing | Δ | Δ | X | | | |
| Comparative example 10 | Frictional charge quantity (μc/g) | 10.4 | 11.1 | 8.2 | 8.0 | 9.5 | 5.1 |
| | I.D. | 1.40 | 1.36 | 1.43 | 1.42 | 1.38 | 1.42 |
| | B.G. | 0.34 | 0.44 | 0.36 | 0.48 | 0.76 | 0.65 |
| | Toner splashing | Δ | ○ | Δ | X | Δ | X |

TABLE 9

| | | Initial | | | 5000 sheets | | |
|---|---|---|---|---|---|---|---|
| | | N/N | L/L | H/H | N/N | L/L | H/H |
| Example 8 | Frictional charge quantity (μc/g) | 12.7 | 15.3 | 11.0 | 13.3 | 17.1 | 10.1 |
| | I.D. | 1.34 | 1.31 | 1.35 | 1.30 | 1.33 | 1.35 |
| | B.G. | 0.21 | 0.33 | 0.55 | 0.46 | 0.47 | 0.31 |
| | Toner splashing | ○ | ○ | ○ | ○ | ○ | ○ |
| Comparative example 11 | Frictional charge quantity (μc/g) | 10.9 | 12.7 | 7.9 | 7.3 | 12.0 | 4.9 |
| | I.D. | 1.36 | 1.34 | 1.36 | 1.37 | 1.33 | 1.35 |
| | B.G. | 0.38 | 0.48 | 0.69 | 0.67 | 0.86 | 1.15 |
| | Toner splashing | Δ | ○ | X | X | X | X |
| Comparative example 12 | Frictional charge quantity (μc/g) | 10.0 | 13.6 | 8.7 | 9.4 | 14.9 | 5.3 |
| | I.D. | 1.35 | 1.33 | 1.36 | 1.36 | 1.28 | 1.34 |
| | B.G. | 0.19 | 0.37 | 0.59 | 0.52 | 0.78 | 1.23 |
| | Toner splashing | Δ | ○ | X | X | Δ | X |
| Comparative example 13 | Frictional charge quantity (μc/g) | 12.2 | 1.46 | 10.5 | 10.4 | 1.34 | 7.3 |
| | I.D. | 1.34 | 1.31 | 1.35 | 1.31 | 1.29 | 1.33 |
| | B.G. | 0.34 | 0.24 | 0.39 | 0.46 | 0.51 | 0.76 |
| | Toner splashing | ○ | ○ | Δ | Δ | Δ | X |

TABLE 10

| Samples | Bulk specific gravity (g/cc) |
|---|---|
| Example 6 | 0.365 |
| Comparative Example 5 | 0.351 |
| Comparative Example 6 | 0.360 |
| Comparative Example 7 | 0.303 |
| Example 7 | 0.366 |
| Comparative Example 8 | 0.364 |
| Comparative Example 9 | 0.365 |
| Comparative Example 10 | 0.307 |
| Example 8 | 0.363 |
| Comparative Example 11 | 0.355 |
| Comparative Example 12 | 0.358 |
| Comparative Example 13 | 0.305 |

What is claimed is:

1. A toner for developing static charge images, having an aluminum oxide powder adhered to the surface thereof in the amount of 0.01% to 5% by weight, said aluminum oxide powder being treated by a coupling agent and having a specific surface area of not less than 75 $m^2/g$ as measured by BET method so as to adsorb $CO_2$ gas at a rate not more than 4.0 pieces/$nm^2$, wherein said coupling agent is one or more of the materials selected from the group consisting of dimethylsilicone, methyltrimethoxysilane, (3-aminopropyl)trimethoxysilane, (3-aminopropyl)triethoxysilane, (3-(2-aminoethoxyamino)propyl)triethoxysilane, (3-(2-aminoethoxyamino)propyl)trimethoxysilane and $C_8F_{17}SO_2NC_2H_5(CH_2)_3Si(CH_3O)_3$.

2. A toner according to claim 1 wherein said aluminum oxide has a specific surface area of 75 $m^2/g$ to 250 $m^2/g$ and said toner has a negative charging property.

3. A toner according to claim 1 wherein said coupling treatment agent is $C_8F_{17}SO_2NC_2H_5(CH_2)_3Si(CH_3O)_3$.

4. A color toner according to claim 1, comprises a binding agent, coloring agent, and a quaternary ammonium salt, and wherein said aluminum oxide has a specific surface area of not less than 80 $m^2/g$ as measured by BET method, and said color toner has a positive charging property.

5. A toner having a negative charging property for developing static charge images as recited in claim 2, wherein said coupling agent is dimethylsilicone $C_8F_{17}SO_2NC_2H_5(CH_2)_3Si(CH_3O)_3$.

6. A toner having a negative charging property for developing static charge images as recited in claim 2, wherein said coupling agent is methyltrimethoxysilane.

7. A toner having a negative charging property for developing static charge images as recited in claim 2, wherein said coupling agent is 3-aminopropyltrimetoxysilane.

8. A color toner having a positive charged property for developing static charge images as recited in claim 4, wherein said coloring agent is one or more than one sorts of a material selected from the group consisting of monoazo red pigment, disazo yellow pigment, quinacridone magenta pigment and copper phthalocyanine blue pigment.

9. A color toner having a positive charged property for developing static charge images as recited in claim 4, wherein said agent includes coupling are dimethylsilicone and $C_8F_{17}SO_2NC_2H_5(CH_2)_3Si(CH_3O)_3$.

* * * * *

UNITED STATES PATENT AND TRADEMARK OFFICE

CERTIFICATE OF CORRECTION

PATENT NO. : 5,334,472

DATED : August 02, 1994

INVENTOR(S) : Nobuyuki AOKI et al

It is certified that error appears in the above-indentified patent and that said Letters Patent is hereby corrected as shown below:

Claim 3, Column 17, Line 11 change "claim 1" to --claim 2--.

Claim 7, Column 18, Lines 8-9 change "3-aminopropyltrimetoxysilane" to --3-aminopropyltrimethoxysilane--.

Claim 8, Column 18, Line 13 change "sorts" to --sort--.

Claim 9, Column 18, Line 19 change "agent includes coupling are" to --coupling agent includes--.

Signed and Sealed this

Eleventh Day of April, 1995

Bruce Lehman

*Attest:*

BRUCE LEHMAN

*Attesting Officer*

*Commissioner of Patents and Trademarks*